US007735151B1

(12) United States Patent
Young et al.

(10) Patent No.: US 7,735,151 B1
(45) Date of Patent: Jun. 15, 2010

(54) BREAKAWAY VEST

(76) Inventors: Philip Young, P.O. Box 2276, Thomasville, NC (US) 27361; Tamara L. Joyce, P.O. Box 2276, Thomasville, NC (US) 27361

( * ) Notice: Subject to any disclaimer, the term of this patent is extended or adjusted under 35 U.S.C. 154(b) by 0 days.

(21) Appl. No.: 11/502,611

(22) Filed: Aug. 10, 2006

(51) Int. Cl.
*A41D 3/02* (2006.01)

(52) U.S. Cl. ..... 2/96

(58) Field of Classification Search ..... 2/48, 2/69, 102, 456, 460–463, 467, 44, 45, 50, 2/51, 2.5, 94, 108, 326, 327–334, 96
See application file for complete search history.

(56) References Cited

U.S. PATENT DOCUMENTS 5,127,106 A * 7/1992 Aldridge ..... 2/81
5,495,621 A 3/1996 Kibbee ..... 2/2.5
5,653,244 A * 8/1997 Shaw ..... 128/882
5,799,329 A * 9/1998 Hauschild ..... 2/102
5,890,227 A 4/1999 Brown ..... 2/102
D440,716 S 4/2001 Lesley ..... D29/101
6,820,280 B1 * 11/2004 Atallah et al. ..... 2/102
6,948,188 B2 * 9/2005 D'Annunzio ..... 2/102
7,152,246 B2 * 12/2006 Infante ..... 2/22

OTHER PUBLICATIONS

MBTA Safety Vest diagram; received by applicant Apr. 15, 1999.
Photograph of a Carolina Safety Vest, sold Sep. 2000.
Wisconsin Dept. of Transportation Traffic Vest; received by applicant Feb. 23, 1999.

* cited by examiner

*Primary Examiner*—Tejash Patel
(74) *Attorney, Agent, or Firm*—MacCord Mason PLLC

(57) ABSTRACT

A safety vest is claimed and described. In preferred embodiments, the vest includes a front panel formed from a first section and a second section. The vest also includes a donning fastener having a first and second side. The first donning fastener side connects to the first section of the front panel. The vest also includes a safety fastener having a first safety fastener side and a second safety fastener side. In most embodiments, the first side of the safety fastener is positioned on the second donning fastener side. The second safety fastener side is connected to the second section of the front panel. The vest can be donned, secured, and removed with the donning fastener and, because of safety fasteners, will safely break away from a wearer under tension.

17 Claims, 5 Drawing Sheets

BREAKAWAY VEST

BACKGROUND (1) Field

This disclosure relates generally to garments, and, more particularly, to vests for increased safety.

(2) Related Technology

Traditional breakaway vests are known in the art. While they are commonly designed to increase visibility, they are primarily designed to breakaway from the wearer's body under tension or during a safety emergency. Such a feature is desirable, for example, for police officers or public transit workers who risk having portions of their clothing caught in or on vehicles. If these situations do occur, breakaway vests reduce the risk of workers being dragged by breaking away from the wearer's body under tension. Breakaway garments and vests are also desirable for machine workers, e.g., press operators, trash collectors, or wood chip operators, who risk having clothing caught in machinery. For these types of workers, becoming entangled with machinery may result in extreme bodily harm, if not death.

Some traditional breakaway vests are based on a pull-over design. For a variety of reasons, however, (e.g., bulky uniforms, excessive equipment and accessories, inflexibility) pull-over vests may not be easy or practical for all wearers to put on and take off. Because of this inconvenience, many who should be wearing a safety vest at all times do not. This oversight can lead to injury or loss of life.

To overcome the aforementioned problem, others open the vest at its safety fasteners, which are commonly hook and loop fasteners, e.g., VELCRO, in an attempt to ease donning the garment. This technique, however, is time consuming because it is difficult to properly align the various hook and loop portions of the garment. Because of these problems, many may not wear their breakaway vests at all times, or may not wear their vests properly, which may lead to injury or loss of life.

Thus what is needed is a breakaway garment that provides safety features of traditional garments, but that further reduces the risk of injury and loss of life by being easy and comfortable to put on properly, secure, and take off.

SUMMARY OF THE DISCLOSURE

This disclosure describes breakaway garments designed to improve safety and reduce the risk of injury and loss of life. The garment includes a front panel including a front upper portion and a front lower portion. The front panel includes at least a pair of sections joined by a donning fastener. The donning fastener is configured to facilitate donning, securing, and removing the garment. The front panel also includes a first safety fastener configured to allow the front panel to separate under tension above a breakaway threshold, which may be, for example, a pound of tension. In this embodiment, a back panel having a back upper portion and a back lower portion is coupled to the front panel.

In most embodiments, the donning fastener is a zipper and the first safety fastener is a hook and loop fastener. In many embodiments, the front and back panels are coupled by a plurality of second safety fasteners, which preferably include a pair of upper safety fasteners configured to connect the upper front portion of the front panel to the upper back portion of the back panel, and a pair of lower safety fasteners configured to connect the lower front portion of the front panel to the lower back portion of the back panel. Preferably, the plurality of second safety fasteners are hook and loop fasteners.

The vests may be multi-colored, and further may include fluorescent orange and fluorescent lime-yellow portions, or other high visibility colors. In addition, the vests may include a plurality of reflective portions, e.g., chevrons, and, optionally, pockets or pen and microphone holders. The disclosure also provides vests that are ANSI/ISEA 107-2004 Class 2 compliant, and also compliant with the possible future ANSI/ISEA 207-200X Public Safety Vest Standard.

DESCRIPTION OF EMBODIMENTS

Figure 1:
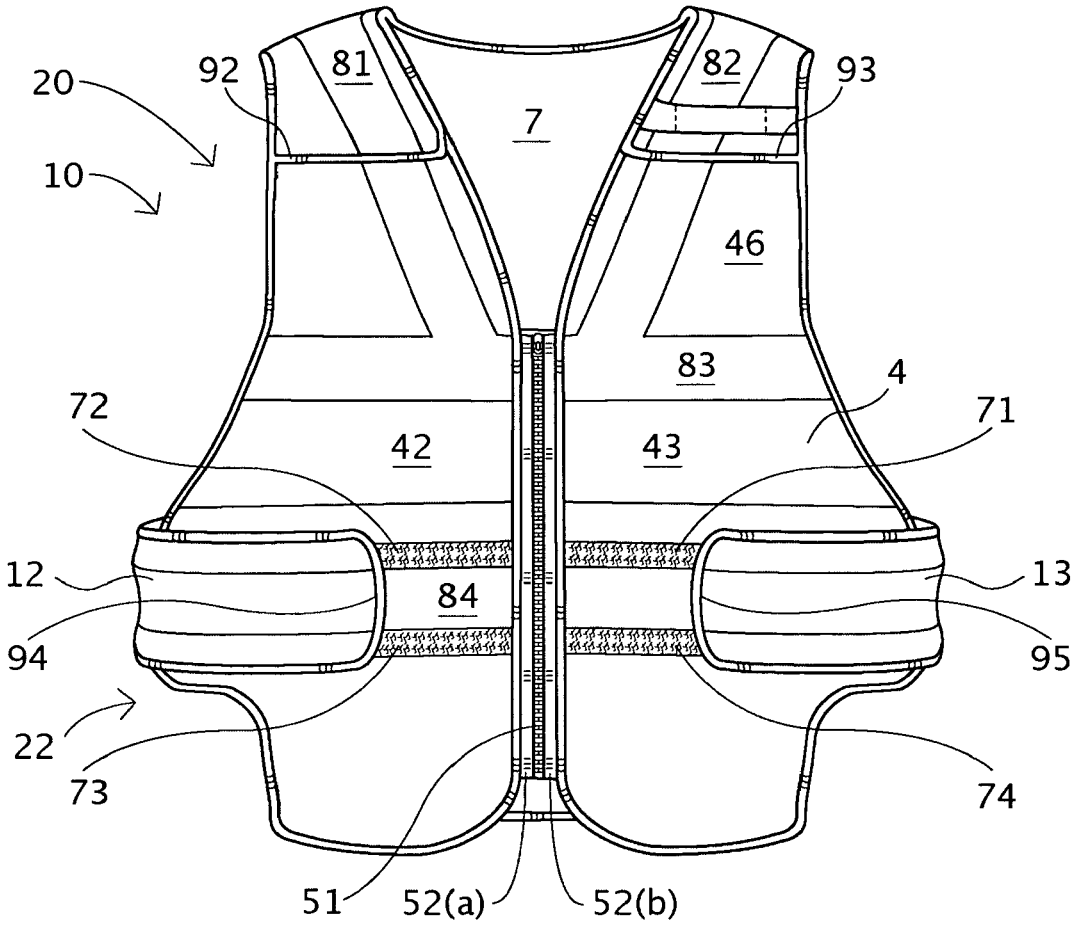
FIG. 1 is a front view of an embodiment of a breakaway garment.

In the following description, like reference characters designate like or corresponding parts throughout the several views. Also in the following description, such terms as "forward," "rearward," "left," "right," "upwardly," "downwardly," and the like are words of convenience and are not to be construed as limiting terms. Also, the illustrations and descriptions are for disclosing various embodiments of a breakaway vest and do not limit the vest to any particular embodiment disclosed.

FIG. 1 shows one embodiment of a safety garment 10 of the present invention. While the garment depicted is a vest, and in particular a breakaway vest, the present invention is inclusive of other breakaway garments as well, for example, breakaway jackets. Vest 10 includes front panel 4 (also shown individually in FIG. 2) coupled to back panel 7 (also shown individually in FIG. 3). Front panel 4 includes upper portion 20 and bottom portion 22, and back panel 7 includes upper portion 24 (see FIG. 3) and bottom portion 26 (see FIG. 3).

Front panel 4 includes a pair of front panel sections, depicted here as section 42 and section 43, which are joined by donning fastener 51. Donning fastener 51 is configured to facilitate donning, securing, and removing the garment, and is, in this embodiment, depicted as zipper 51. Zipper 51 may be any of the variety of zippers available, and may be for example, a tooth or coil style zipper and may be locking or non-locking. Preferably zipper 51 is a separating zipper. Zipper 51 includes a first tape 52(*a*) on one side of the zipper and a second tape 52(*b*) on the opposite side of the zipper. While, as depicted, first tape 52(*a*) is shown on the left of the zipper and second tape 52(*b*) is shown on the right of the zipper, "first" and "second" are not intended to impart any positional limitation. For example, in other embodiments, tape 52(*a*) may be the second tape and tape 52(*b*) may be the first tape. In other embodiments, the donning fasteners can be conventional means for closing a garment, but not elongated strips of hook and loop fasteners. For example, others may desire buttons, snaps, hooks, buckles, or loops, all of which are within the scope of the present invention.

Figure 2:
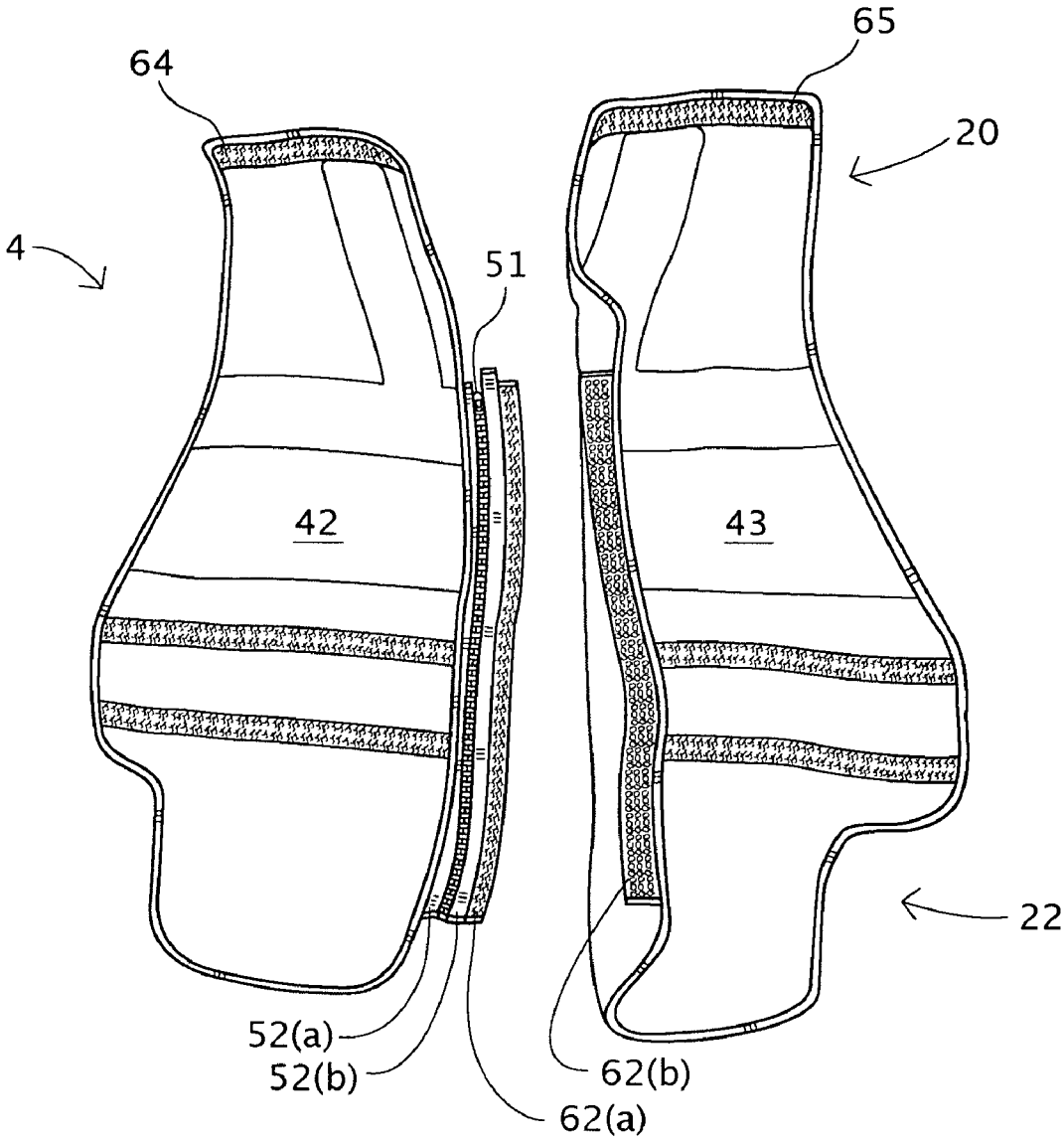
FIG. 2 is a front view a panel of the embodiment.
Figure 3:
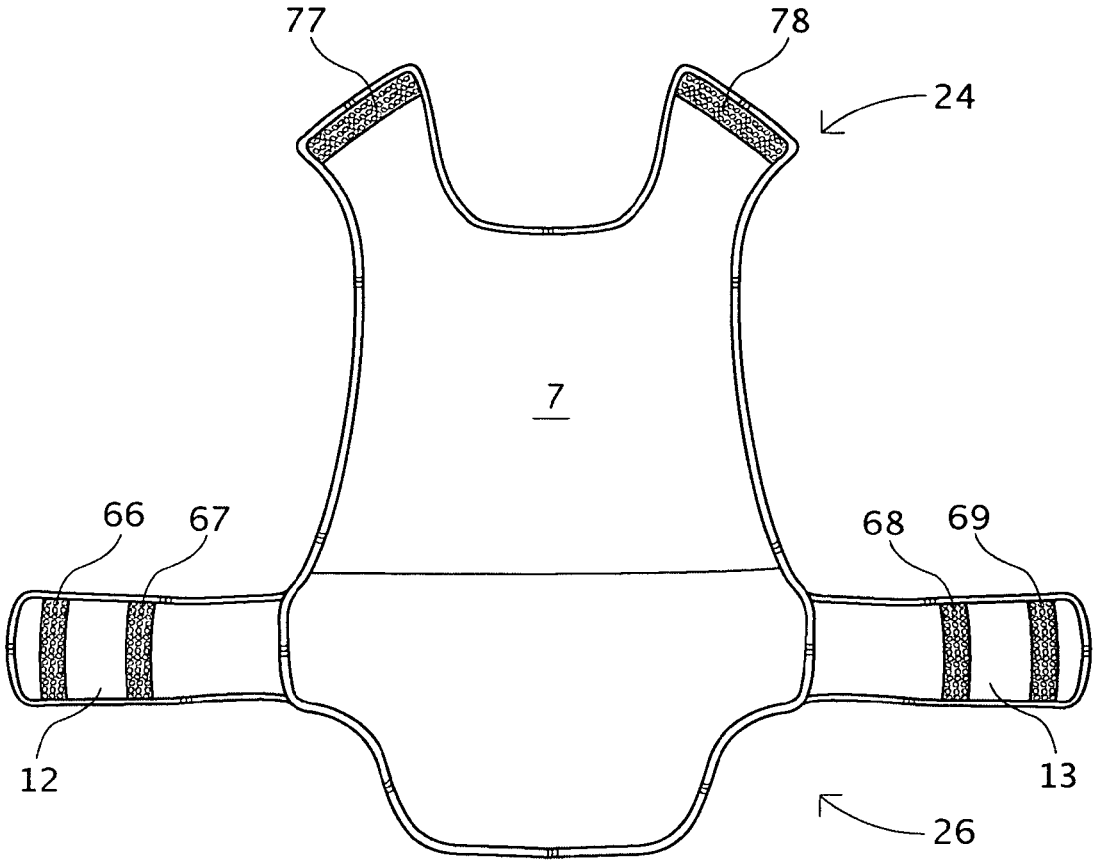
FIG. 3 is a front view of a panel of the embodiment.

FIG. 2 shows a first safety fastener 62 of the present embodiment. First safety fastener 62 is configured to allow panels to separate under tension above a breakaway threshold. While the tension may vary from embodiment to embodiment, in some embodiments 1 pound, 2 pounds, 3 pounds, or 4 pounds of tension may be ideal. Still others may prefer more or less tension. Somewhat similarly, others may desire a breakaway threshold tension based on current or future ANSI standards or recommendations. Those skilled in the art will recognize that the threshold tension may be adjusted, for example, in hook and loop embodiments, by increasing the number of hooks and loops per unit of area, or by using larger, stronger, or more rigid hook and loop fasteners.

In the embodiment of FIG. 2, first safety fastener is a hook and loop fastener, e.g. VELCRO, and includes a first tape 62(*a*) and a second tape 62(*b*). The "first" and "second" adjectives are used for descriptive purposes and are not intended to impart any numeric or positional limitations to first safety fasteners of the present invention. Zipper 51 is connected at first tape 52(*a*) to the first section 42 of front panel 4. Hook and loop fastener 62, is connected at side 62(*a*) to the second tape 52(*b*) of zipper 51. The second side of hook and loop fastener 62(*b*) is connected to the second section 43 of front panel 4. When in use, hook and loop side 62(*a*) is fastened to hook and loop side 62(*b*) until it is torn away by tension. Those skilled in the art will recognize that either 62(*a*) or 62(*b*) may be either the hook or the loop portion of the hook and loop fastener. Zipper 51 is used to put on and remove the vest during everyday use. Such a configuration allows for the safety garment to be easily donned and secured over bulky uniforms and clothing, while at the same time increases a wearer's safety by allowing the garment to be easily torn off in the event it becomes entangled.

While in the preferred embodiments, front panels have a pair of sections, e.g., first section 42 and second section 43, other embodiments of the invention may have additional sections. For example, some embodiments of the invention may include three sections in the front panel, wherein, for example, the donning fastener connects a first and second section and wherein the safety fastener connects a second and third section. All such embodiments are considered to be within the scope of the present invention.

In preferred embodiments, the front and back panels of the garments of the present invention are coupled by a plurality of second safety fasteners. Preferably, the plurality of second safety fasteners includes a pair of upper safety fasteners 92 and 93, and a pair of lower safety fasteners 94 and 95, configured to connect front panel 4 with back panel 7. In the preferred embodiment, the plurality of second safety fasteners include hook and loop fasteners, with mating portions of hook and loops shown generally as horizontal strips 64, 65, 71, 72, 73, 74, 77 and 78 (seen in various figures). As shown in FIG. 1, in some embodiments, it may be desirable to position upper safety fasteners 92 and 93 drop-shoulder, for example, to increase comfort and prevent safety fasteners from snagging of uniforms or tools located about uniforms.

Preferably, lower safety fasteners 94 and 95 connect the lower front portion 22 of panel 4 to the lower back portion 26 of panel 7 with arms 12 and 13 (also visible in FIG. 3), which are positioned to wrap around a wearer's waist. While arms are preferable for practicing certain embodiments of the present invention, for example, for allowing a single vest to fit a variety of wearers wearing a variety of clothing or uniforms, in other embodiments front portion 22, may connect to back portion 26 directly, e.g., without the use of arms.

Figure 5:
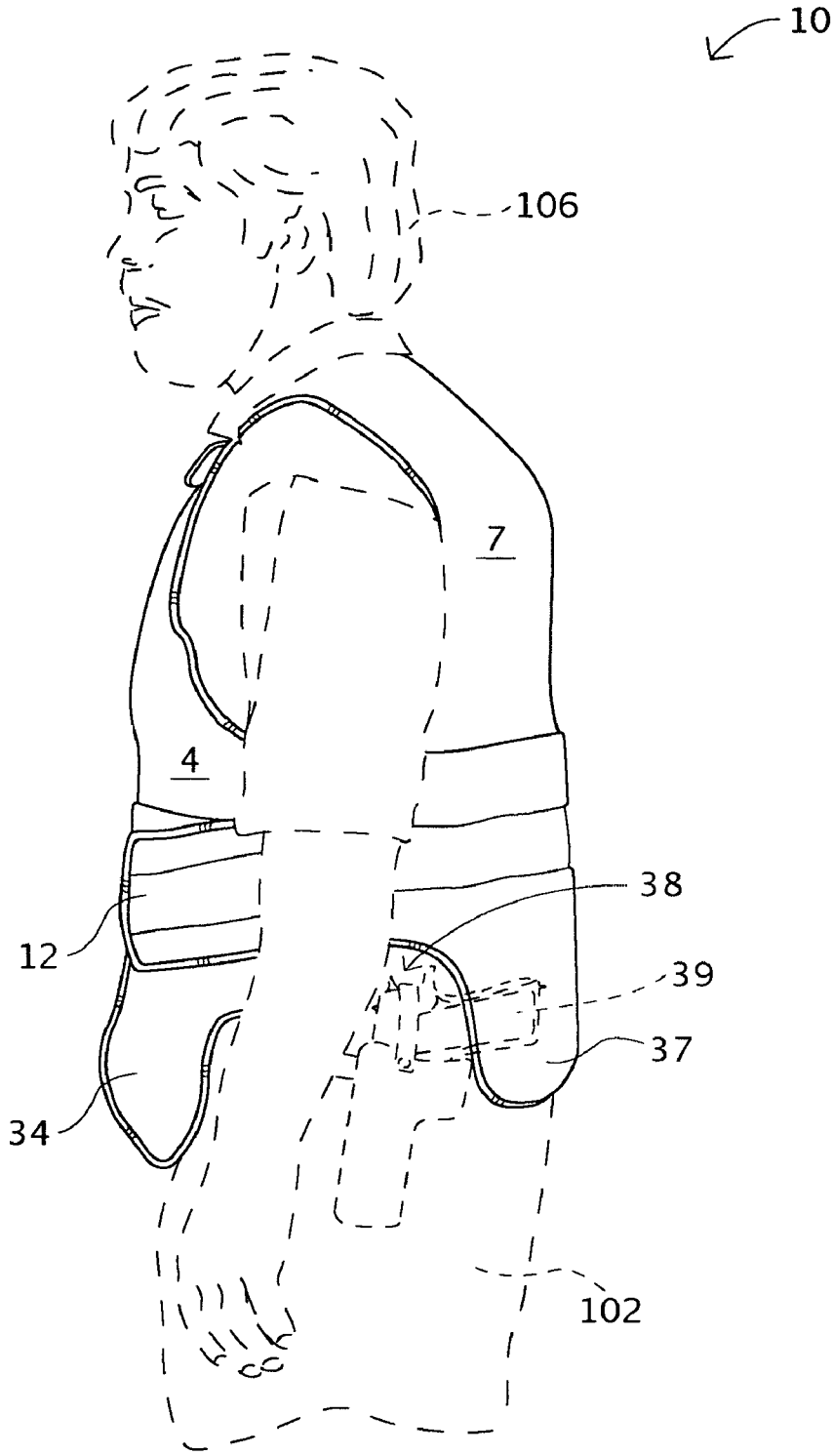
FIG. 5 is a side view of the embodiment on a wearer.

FIG. 5 shows vest 10 on a wearer 106, who may be, for example, a police officer. Vest 10 includes tool access 38 that is defined, at least in part, by either the front or back panel. Tool access 38 is configured to allow a wearer to access tools, e.g., gun 39, located on the wearer's belt, hip or lower leg region, and allow vest 10 to be torn away under tension without becoming caught on tools located in the same region. In the preferred embodiment shown, the depicted tool access 38 is defined at its sides by both portion 34 of the front panel and by portion 37 of the back panel, and to some extent, at its top by arm 12. Preferably, tool access 38 has a height of about 7 inches and width of about 8 inches, which allows wearers to access multiple, or a variety of different, tools. While only one tool access is shown, the opposite side of vest 10 may include a similar tool access. Others may wish to practice the present invention using other configurations for the tool access.

Most embodiments of the garment of the present invention may also include high-visibility coloring or a reflective portion, and many embodiments, e.g., high visibility safety vests, will preferably include both high visibility coloring and reflective tape. For example, referring to the vest shown in FIG. 1, portion 46 may be considered to be any high visibility coloring, and will preferably be a high visibility coloring in compliance with ANSI safety standards, and tape 83 may be considered to be reflective tape. Other portions of the vest may also be considered to be either high visibility or reflective as well. Referring to the back view of panel 7 shown in FIG. 4, other reflective and high visibility portions may be seen. For example, portions 57 and 58 may be high visibility, while a portions 88 and 89, which are shown in chevron formation, may be reflective tape.

Figure 4:
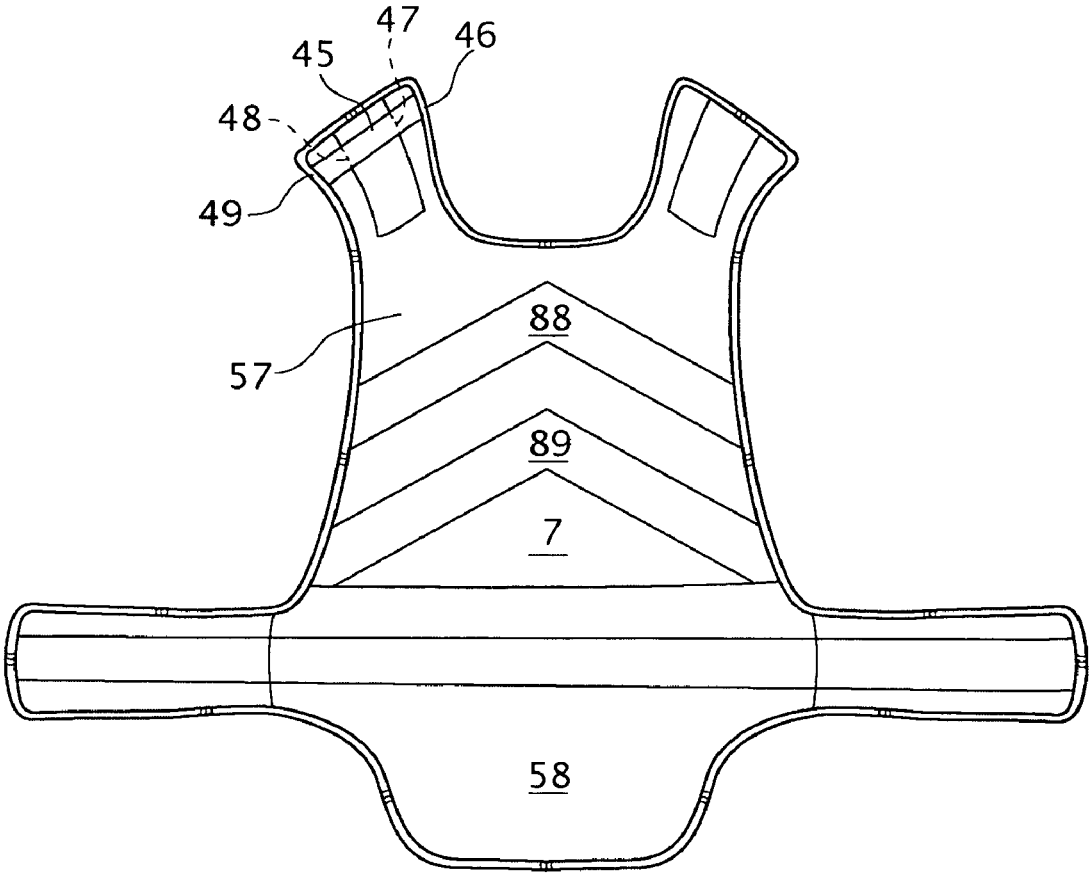
FIG. 4 is a back view of the panel shown in FIG. 3.

FIG. 4 also shows a band of material 45 is secured along four axes 46, 47, 48 and 49 to the panel 7 to form a clip capable of receiving and retaining items such as radio microphones and pens.

Numerous characteristics and advantages have been set forth in the foregoing description, together with details of structure and function. The novel features are pointed out in the appended claims. The disclosure, however, is illustrative only, and changes may be made in detail, especially in matters of shape, size, and arrangement of parts, within the principle of the invention, to the full extent indicated by the broad general meaning of the terms in which the general claims are expressed.

We claim:

1. A safety upper torso garment comprising:

(a) a front panel extending from about the waist and hip region to about the shoulders, said front panel including (i) a front upper portion in the vicinity of said shoulder region and a front lower portion in the vicinity of said hip region, (ii) at least a pair of separating sections being configured to extend from about said waist and hip region to about said shoulders, (iii) a donning fastener including two complementary sides configured to releasably fasten to each other, wherein one side of the donning fastener is separable from the garment, wherein said donning fastener is positioned in between said at least a pair of separating sections, wherein said donning fastener extends from about said waist and hip region to about the chest region, and wherein said donning fastener is configured to facilitate donning, securing, and removing the garment, and (iv) a hook and loop fastener including two sides configured to releasably connect to each other, wherein one side of said hook and loop fastener is connected to said donning fastener and extends substantially along the length of said donning fastener and wherein the other side is connected to one of said separating sections, wherein said hook and loop fastener is configured to allow said front panel sections to separate under tension above a pre-determined breakaway threshold when said donning fastener is in a closed position; and (b) a back panel having a back upper portion and a back lower portion and coupled to said front panel.

2. The garment of claim 1, wherein said donning fastener is a zipper.

3. The garment of claim 2, wherein said zipper is a separating zipper and one of said sides of said donning fastener includes a first tape of said zipper and another of said sides of said donning fastener includes a second tape of said zipper.

4. The garment of claim 3, wherein either said first tape or second tape of said zipper is attached to any of said at least two panels by a hook and loop fastener.

5. The garment of claim 1, wherein said front panel is coupled to said back panel by a plurality of second safety fasteners.

6. The garment of claim 5, wherein said plurality of second safety fasteners includes a pair of upper safety fasteners configured to connect said upper front portion to said upper back portion.

7. The garment of claim 6, wherein said pair of upper safety fasteners include hook and loop fasteners.

8. The garment of claim 6, wherein said pair of upper safety fasteners are positioned drop-shouldered.

9. The garment of claim 5, wherein said plurality of second safety fasteners includes a pair of lower safety fasteners configured to connect said lower front portion to said lower back portion.

10. The garment of claim 9, wherein said lower safety fasteners include a pair of arms extending between said first panel and said second panel, and positioned to wrap around a wearer's waist.

11. The garment of claim 9, wherein said lower safety fasteners include hook and loop fasteners.

12. The garment of claim 1, further including a tool access defined, at least in part, by either said front or back panel, thereby allowing a wearer to access tools.

13. The garment of claim 12, wherein said tool access has a height of about 7 inches and width of about 8 inches.

14. The garment of claim 1, wherein said panels include a high-visibility coloring.

15. The garment of claim 1, wherein said panels include a reflective portion.

16. The garment of claim 1, wherein said garment is a vest.

17. A safety vest comprising:

(a) a front panel formed from a first section and a second section each extending from about the waist and hip region to about the shoulders, said front panel having an upper front portion and a lower front portion;

(b) a zipper having a first tape and a second tape, wherein said first tape is connected to said first section of said panel;

(c) a hook and loop fastener having a first fastener side and a second fastener side, wherein said first fastener side is positioned on said second zipper tape and wherein said second fastener side is connected to said second section of said front panel;

(d) a back panel having a back upper portion releasably coupled to said front upper portion by a pair of upper second safety fasteners and a back lower portion releasably coupled to said front lower portion by a pair of lower second safety fasteners, thereby allowing said vest to be donned and secured with said zipper being configured to allow the front panel to break away under tension above a breakaway threshold when said zipper is in a closed position; and a tool access defined, at least in part, by either said front or back panel, thereby allowing a wearer to access tools.

* * * * *